United States Patent [19]

Eke

[11] Patent Number: 4,771,152

[45] Date of Patent: Sep. 13, 1988

[54] MICROWAVE OVENS AND METHODS FOR COOKING PRIMARILY BAKED GOODS AND FROZEN FOODS

[75] Inventor: Kenneth I. Eke, South Croydon, England

[73] Assignee: Microwave Ovens Limited, Shirley, England

[21] Appl. No.: 58,130

[22] Filed: Jun. 4, 1987

[30] Foreign Application Priority Data

Jun. 4, 1986 [GB] United Kingdom ..... 8613552

[51] Int. Cl.[4] ..... H05B 6/68

[52] U.S. Cl. ..... 219/10.55 B; 219/10.55 M; 99/325

[58] Field of Search ..... 219/10.55 B, 10.55 M, 219/10.55 E; 99/325, 451; 426/243, 523

[56] References Cited

U.S. PATENT DOCUMENTS

| | | | |
|---|---|---|---|
| 4,447,693 | 5/1984 | Buck | 219/10.55 M |
| 4,481,394 | 11/1984 | Tanabe | 219/10.55 B |
| 4,488,026 | 12/1984 | Tanabe | 219/10.55 B |
| 4,508,947 | 4/1985 | Eke | 219/10.55 B |
| 4,508,948 | 4/1985 | Carlson | 219/10.55 M |
| 4,584,448 | 4/1986 | Tanabe | 219/10.55 B |
| 4,661,670 | 4/1987 | Eke | 219/10.55 E X |

*Primary Examiner*—Philip H. Leung
*Attorney, Agent, or Firm*—Penrose L. Albright

[57] ABSTRACT

A microwave oven having a cavity for receiving food items to be cooked, primarily baked goods and frozen foods, a magnetron for delivering microwave power to the cavity, and a forced hot air system, including a fan and an electrical resistance heating element which are both disposed in a compartment separated from the cavity by a dividing panel. The oven has a thermistor for monitoring air temperature drawn from the oven cavity after a predetermined time, between four and eight minutes, from the commencement of cooking. Dependent upon the sensed temperature being below or above a predetermined threshold temperature between 130° C. and 140° C., a microprocessor determines a category for the food item being cooked with a corresponding final cooking temperature to be attained for completion of cooking by referring to an internal program that relates to the particular food item to be cooked. The delivery of hot air and magnetron power are terminated when the corresponding final cooking temperature is sensed by the thermistor.

17 Claims, 2 Drawing Sheets

MICROWAVE OVENS AND METHODS FOR COOKING PRIMARILY BAKED GOODS AND FROZEN FOODS

FIELD OF THE INVENTION

This invention relates to microwave ovens and methods for cooking.

SUMMARY OF THE INVENTION

According to the invention a microwave oven has a food-receiving cavity, a magnetron for supplying microwave power to the cavity and a forced hot air system comprising an electrical resistance heating element and a fan for forcing a stream of hot air over the electrical resistance heating element and through the cavity simultaneously with the delivery of microwave power to the cavity, temperature sensing means for sensing the temperature of the hot air flow, timing means for recording cooking time from commencement with the oven cavity in a cold condition, and control means operative to:

1. sense the hot air temperature after a predetermined time from the commencement of cooking, 2. place the foodstuff being cooked into a first category if the sensed temperature after the predetermined time is below a predetermined threshold temperature and to place the foodstuff being cooked into a second category if the sensed temperature at the predetermined time is above the predetermined threshold temperature, 3. continue the simultaneous delivery of microwave power and hot air power into the cavity until a first category final cooking temperature has been reached for a foodstuff in the first category, or continue the simultaneous delivery of microwave power and hot air power into the cavity until a second category final cooking temperature, higher than the first food category final cooking temperature, has been reached for a foodstuff in the second category.

In one embodiment the production of microwave power and hot air power is discontinued to terminate the cooking process when the first or second cavity temperature has been reached.

In another embodiment, the particular time at which, selectively, the first food category final cooking temperature or second food category final cooking temperature is reached is used to determine the total cooking time by reference to a characteristic relating the particular time to the total cooking time.

The invention was devised to distinguish between baked items of food, (such as pies, flans and similar pastry items) and frozen food items. In the invention, the baked food items are placed in the first category and the frozen food items in the second category.

As a result of practical tests, it has been found that baked items cooked in high-sided metal containers, eg cakes cooked in high-sided cake pans, need to be placed in the second category in order to be cooked satisfactorily. Hence, the invention can be used to distinguish baked food items in normal glass or low-sided metal containers (all of which are placed in the first category) from frozen food items and baked items cooked in high-sided metal containers (all of which are placed in the second category).

The predetermined time is preferably between four and eight minutes, conveniently about six minutes. The predetermined threshold temperature is preferably between 130° and 140° C., conveniently about 135° C. The final cooking temperature for foods in the first category is conveniently between 180° and 190° C., conveniently about 184° C. The final cooking temperature for food items in the second category is preferably between 200° and 210° C., conveniently about 204° C.

BRIEF DESCRIPTION OF THE DRAWINGS

The invention will now be further described, by way of example, with reference to the accompanying drawings in which.

DESCRIPTION OF THE PREFERRED EMBODIMENT

Figure 1:
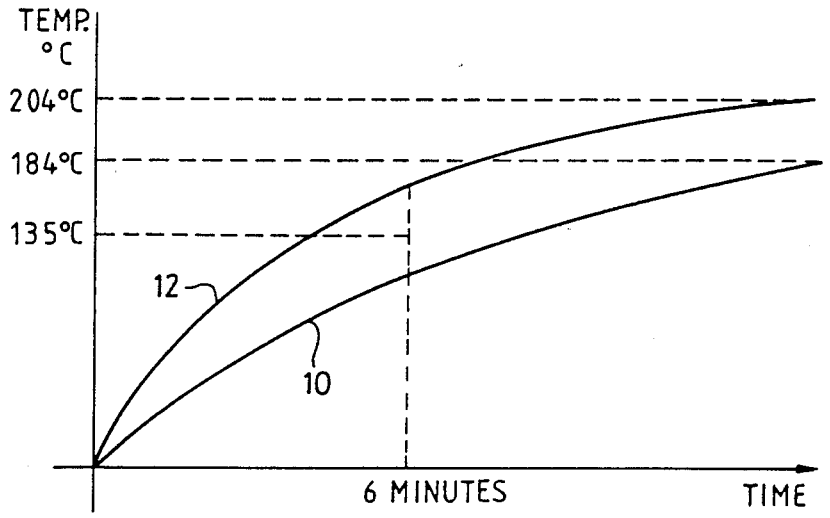
FIG. 1 is a temperature/time graph.

The microwave oven forming the preferred embodiment of this invention is similar in construction to the microwave oven disclosed in the applicants UK specification No. 2127658 and European patent specification No. 0099705. These are the equivalent of U.S. Pat. No. 4,508,947. In particular, the oven comprises a food-receiving cavity 20, a magnetron 22 for supplying microwave power to the cavity, and a forced hot air system for forcing a supply of hot air through the cavity simultaneously with the delivery of microwave power. The forced hot air system comprises an electrical resistance heating element 24 and a fan 26, both of which are accommodated in a compartment 28 disposed behind a rear panel 30 of the cavity 20. Inlet apertures 32 and outlet apertures 34 in the rear panel enable a flow of air to be forced by the fan 26 over the electrical resistance heating element 24 and thence through the cavity 20.

The temperature of the hot air flow is sensed by a thermistor 36 disposed adjacent the fan. The oven has a timer 38 for recording cooking time from the commencement of cooking with the oven in a cold condition, ie less than 80° C. An electronic control means 40, for example, a microprocessor, governs the operation of the magnetron 22 and the forced hot air system in dependence upon the temperature and time.

The control means 40 determines the sensed temperature at the predetermined time of six minutes. If this sensed temperature at six minutes is below the predetermined threshold of 135° C., microwave power and hot air are continued until a first final cooking temperature of 184° C. has been reached. When the sensed temperature reaches 184° C., the production of microwave power and forced hot air power stops and cooking ceases. It has been found that the temperature of the hot air flow is below 135° after six minutes for the following food items: apricot flan, quiche lorraine, popovers, meat pie, cheesecake and apple pie. These foodstuffs can thus be regarded as all being in the first category, for which the oven switches off at 184° C.

For the remaining items, which fall in the second category, the sensed temperature at six minutes is greater than 135° C., these items being the frozen pies and the cakes cooked in high-sided metal containers. For these items, the oven automatically switches off at 204° C.

FIG. 1 is a temperature/time graph. Food items following curve 10 are identified at six minutes as being in the first category, switch off occurring at 184° C. Food items following curve 12 are identified at six minutes as being in the second category, for which switch off occurs at 204° C.

In all cases once the predetermined time has been reached the oven displays the required further cooking time on a digital time display 42 which counts down to zero as the further cooking time elapses, reaching zero at the end of the further cooking time, so that the user has an indication of when cooking time will be completed. Also, in all cases the microwave and hot air power levels are maintained constant throughout at 1100 watts hot air power and 200 watts microwave power into the cavity.

Figure 2:
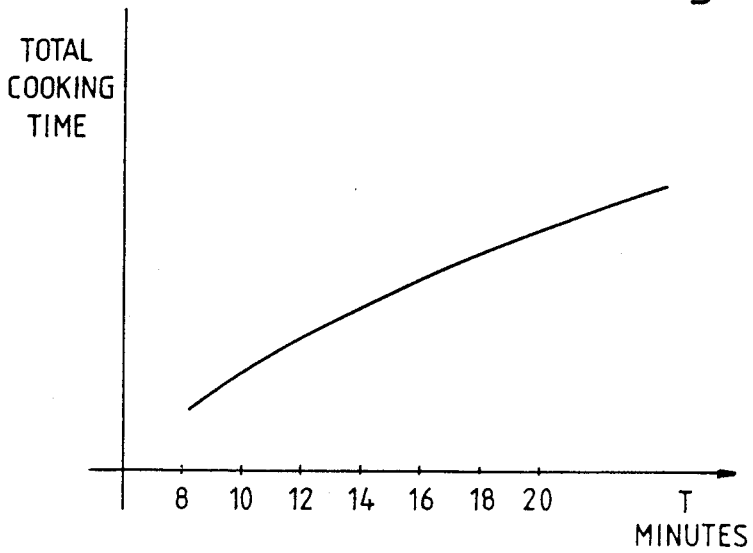
FIG. 2 shows a characteristic relating particular time T to total cooking time.
Figure 3:
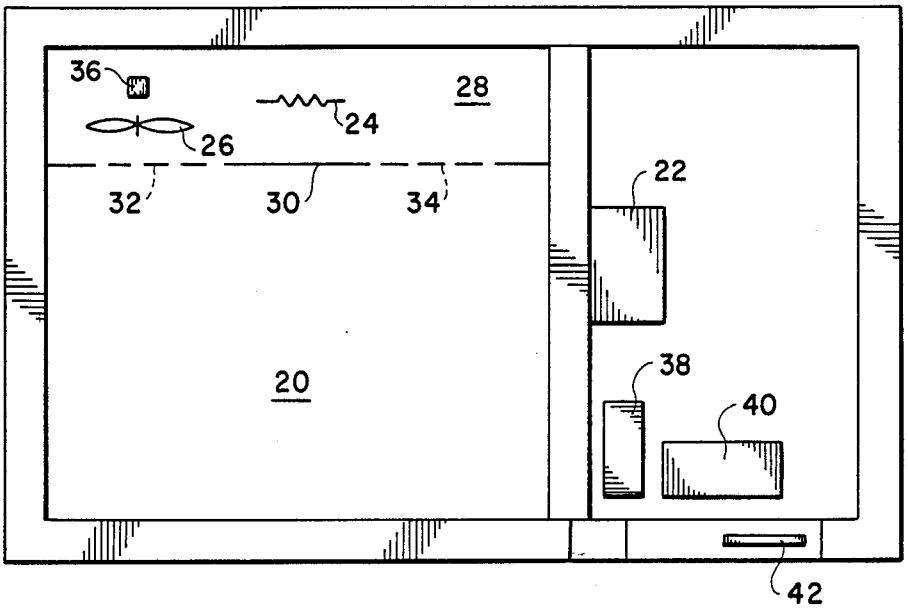
FIG. 3 is a diagrammatic plan view of the oven.

FIG. 2 illustrates a modification in which cooking does not terminate at the attainment of the first category final cooking temperature or second food category final cooking temperature, 184° C. or 204° C., respectively. Instead, when the food category final cooking temperature selected is reached the microprocessor notes the particular time T at which this occurs and determines the total cooking time by reference to the characteristic of FIG. 2 which is pre-programmed in the microprocessor. The horizontal axis in FIG. 2 is the particular time T, and the vertical axis is the total cooking time. Between time T and the attainment of the total cooking time, the oven continues to produce hot air and microwave power simultaneously at the power levels previously mentioned.

To compensate for ambient temperature differences and variation between foodstuffs, the hot air temperature may be sensed at two times, e.g. after six minutes and fourteen minutes from the commencement of cooking, and the temperature difference at these times computed and used to place the food in the first or second category.

Having disclosed my invention, what I claim as new and to be secured by Letters Patent of the United States is:

1. A microwave oven which comprises: a food-receiving cavity; a magnetron for delivering microwave power to said cavity; a forced hot air system including an electrical resistance heating element and a fan for forcing a stream of air over said electrical resistance heating element and through said cavity simultaneously with delivery of microwave power to said cavity; a temperature sensing means for sensing the temperature of the hot air flow exiting said cavity; a timing means for timing cooking from commencement of cooking with said cavity in a cold condition; and control means for controlling the operation of said magnetron and said forced hot air system; said control means operative to (1) sense the temperature of the hot air flow exiting said cavity after a first predetermined time from the commencement of cooking, (2) compare said sensed temperature at said first predetermined time with a predetermined threshold temperature, (3) select, dependent upon whether said sensed temperature for a foodstuff being cooked is below or above said threshold temperature, respectively, a predetermined first food category final cooking temperature or a predetermined second food category final cooking temperature, both said food category final cooking temperatures being greater than said threshold temperature, and (4) continue the simultaneous delivery of microwave power and hot air power into said cavity until said food category final cooking temperature selected is sensed by said temperature sensing means.

2. A microwave oven according to claim 1 further comprising a digital time display which, when said predetermined time is reached, substantially instantaneously, displays said further cooking time interval and counts down from said further time period to zero as said further cooking time elapses, reaching zero when cooking is complete.

3. A microwave oven according to claim 2, wherein first predetermined time is being four and eight minutes.

4. A microwave oven according to claim 3, wherein first predetermined time is substantially six minutes.

5. A microwave oven according to claim 2, wherein said predetermined threshold temperature is between 130° C. and 140° C.

6. A microwave oven according to claim 5, wherein said predetermined temperature is substantially 135° C.

7. A microwave oven according to claim 2, wherein said predetermined first category final cooking temperature is between 180° C. and 190° C.

8. A microwave oven according to claim 7, wherein said predetermined first food category final cooking temperature is substantially 184° C.

9. A microwave oven according to claim 2, wherein said predetermined second food category final cooking temperature is between 200° C. and 210° C.

10. A microwave oven according to claim 9, wherein said predetermined second food category final cooking temperature is substantially 204° C.

11. A microwave oven according to claim 2, wherein said temperature sensing means comprises a thermistor which is located adjacent to said fan.

12. A microwave oven according to claim 1, wherein said control means is further operative to (1) determine a total cooking time in accordance with a predetermined characteristic relating time from commencement of cooking at which said selected food category temperature is reached to total cooking time, and (2) continue the simultaneous delivery of microwave power and hot air power into said cavity from the time said food category selected temperature is sensed by said temperature sensing means until attainment of said total cooking time.

13. A microwave oven according to claim 12, further comprising a digital time display which, which said category temperature selected is sensed by said temperature sensing means, substantially instantaneously, displays said further cooking time interval and counts down from said further time period to zero as said further cooking time elapses, reaching zero when cooking is complete.

14. A microwave oven according to claim 1, wherein said control means comprises a microprocessor.

15. A microwave oven according to claim 1, wherein said control means is further operative to (1) sense the temperature of the hot air flow exiting said cavity after a second predetermined time from the commencing of cooking, (2) compare said sensed temperature at said second predetermined time with a predetermined threshold temperature, (3) re-select, dependent upon whether said sensed temperature for a foodstuff being cooked is below or above said threshold temperature, respectively, said predetermined first food category final cooking temperature or said predetermined second food category final cooking temperature, both said food category final temperatures being greater than said threshold temperature, and (4) continue the simultaneously delivery of microwave power and not air into said cavity until said food category final cooking temperature selected is sensed by said temperature sensing means.

16. A method of cooking food in a microwave oven, comprising supplying continuous microwave power to a cavity of said oven accommodating the food and simultaneously supplying thermal power to said cavity, said thermal power being produced by a forced hot air system including a fan and an electrical heating element located in a space behind a rear panel of said cavity, said fan forcing air across said heating element as the air recirculates from said space through said cavity, until a predetermined time from the commencement of cooking is reached, substantially instantaneously (a) sensing the temperature of air exiting said cavity into said space by a temperature sensing means comprising a thermistor, (b) comparing said sensed temperature against a predetermined threshold temperature, and (c) selecting, dependent upon whether said sensed temperature is below or above said threshold temperature and in accordance with a pre-programmed characteristic relating sensed temperature at said predetermined time and to the category of the food item being cooked, respectively, either a predetermined first food category final cooking temperature or a predetermined second food category final cooking temperature which is greater than said first food category final cooking temperature and further supplying both continuous microwave power to said cavity and thermal power to said cavity, only until said food category final cooking temperature which has been selected is attained.

17. A method of cooking food in accordance with claim 16, further comprising displaying on a digital time display when said predetermined time is reached, a further cooking time interval and counting from said greater time interval displayed to zero as said further cooking time interval elapses, reaching zero when cooking is complete.

* * * * *